US005918437A

United States Patent [19]

Dobija

[11] Patent Number: 5,918,437

[45] **Date of Patent: *Jul. 6, 1999**

[54] WALL SYSTEM PROVIDING AN ARRAY OF INDIVIDUAL PANELS

[75] Inventor: Michael J. Dobija, Lake Forest, Calif.

[73] Assignee: Commercial and Architectural Products, Inc., Dover, Ohio

[ * ] Notice: This patent is subject to a terminal disclaimer.

[21] Appl. No.: 08/889,035

[22] Filed: Jul. 7, 1997

Related U.S. Application Data

[63] Continuation of application No. 08/448,133, May 23, 1995, Pat. No. 5,644,884, which is a continuation of application No. 07/929,759, Aug. 12, 1992, Pat. No. 5,417,020.

[51] Int. Cl.[6] ..... E04B 2/94

[52] U.S. Cl. ..... 52/506.01; 52/287.1; 52/390; 52/461; 52/468; 52/716.8

[58] Field of Search ..... 52/235, 386, 387, 52/390, 506.01, 384, 385, 461, 464, 468, 313, 314, 287.1, 716.8

[56] References Cited

U.S. PATENT DOCUMENTS

| | | |
|---|---|---|
| 1,800,609 | 4/1931 | Drake . |
| 2,073,795 | 3/1937 | Haugaard . |
| 2,101,612 | 12/1937 | Duffy . |
| 2,188,090 | 1/1940 | Young . |
| 2,803,858 | 8/1957 | Rader . |
| 3,304,676 | 2/1967 | Sallie et al. . |
| 3,672,107 | 6/1972 | Santry et al. . |
| 3,838,546 | 10/1974 | Tempes . |
| 4,040,223 | 8/1977 | Hillstrom . |
| 4,067,155 | 1/1978 | Ruff et al. . |
| 4,516,373 | 5/1985 | Osawa . |
| 4,660,339 | 4/1987 | Paz . |
| 4,765,111 | 8/1988 | Osawa . |
| 4,783,941 | 11/1988 | Loper et al. . |
| 4,803,817 | 2/1989 | White et al. . |
| 4,854,095 | 8/1989 | Michlovic . |

FOREIGN PATENT DOCUMENTS

| | | |
|---|---|---|
| 1187185 | 9/1959 | France . |
| 8701061 | 5/1987 | Netherlands . |
| 579693 | 9/1976 | Switzerland . |

*Primary Examiner*—Michael Safavi
*Attorney, Agent, or Firm*—Pearne, Gordon, McCoy & Granger LLP

[57] ABSTRACT

A wall panel system in which individual panels are arranged in vertically adjacent horizontally extending courses. Runners are mounted on the supporting subwall and provide means for establishing alignment between panels and horizontally extending courses. In the first embodiment, an interlocking joint is provided in which clips are used to provide interlocking and provide uniform spacing between adjacent panels. Another embodiment provides battens along the joint between the adjacent horizontally extending courses. Still another embodiment provides battens extending along all the joints between adjacent panels. Various types of trim strips are also disclosed for providing a finished edge in corner appearance.

17 Claims, 10 Drawing Sheets

11
12
33
32
10
3
24
22
26
18
23
13
19
2
16
21
10'
14
28
29
31
27
10"
16

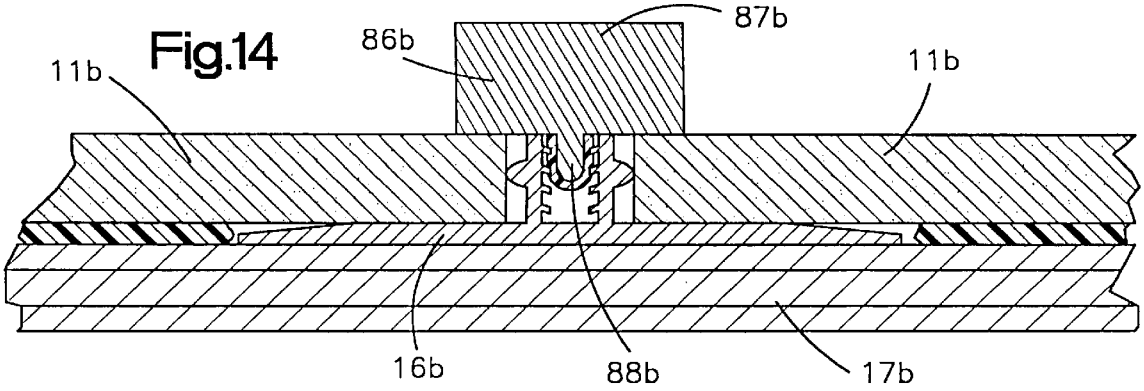
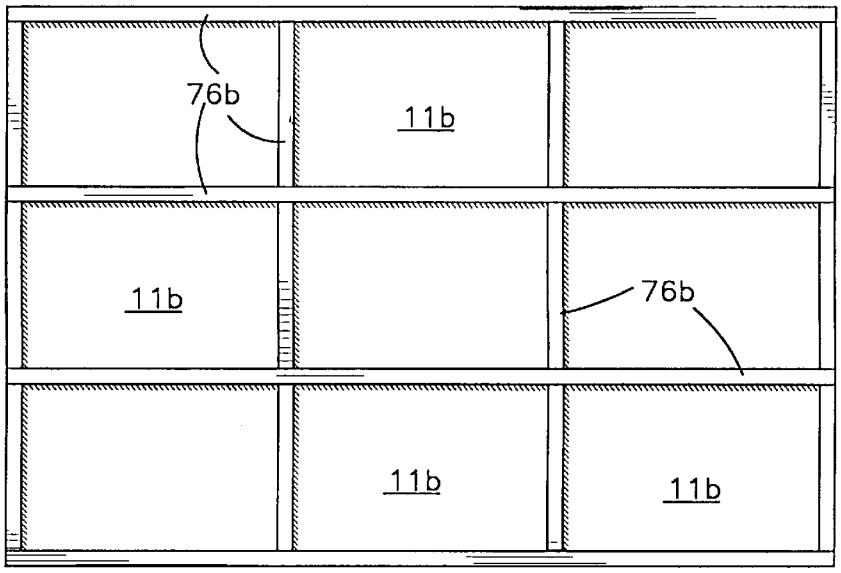
Fig.11
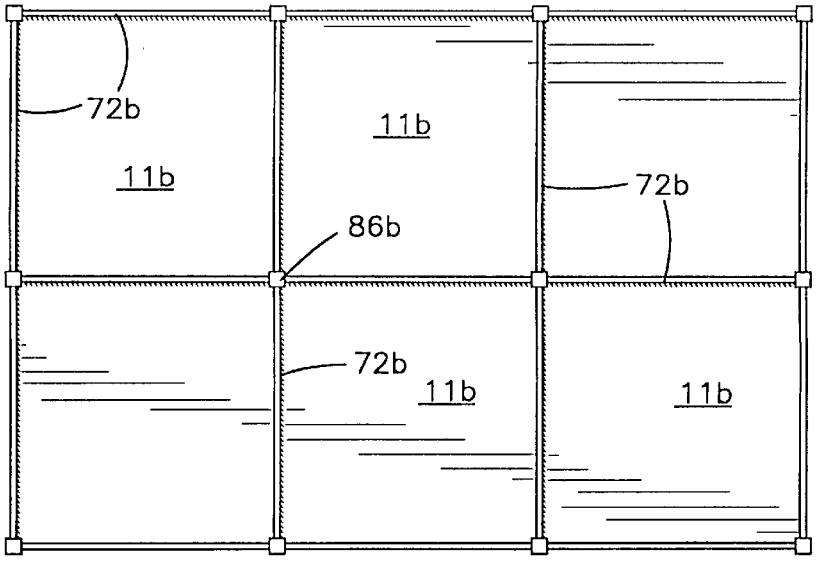
Fig.12

WALL SYSTEM PROVIDING AN ARRAY OF INDIVIDUAL PANELS

This application is a continuation of Ser. No. 08/448,133 dated May 23, 1995 U.S. Pat. No. 5,644,884 which is a continuation of Ser. No. 07/929,759 dated Aug. 12, 1992 U.S. Pat. No. 5,417,020.

BACKGROUND OF THE INVENTION

This invention relates generally to wall paneling systems and, more particularly, to a novel and improved wall paneling system for producing paneled walls consisting of an array of individual panels which are accurately positioned both horizontally and vertically to cooperate and provide a finished wall surface.

PRIOR ART

Systems are known for assembling arrays of individual wall panels to produce a finished wall surface. The U.S. Pat. Nos. 3,838,546, 4,660,339, 4,765,111, 4,783,941 and 4,854,095 each illustrate examples of such systems. In most of such systems, a frame or grid is first installed and the individual panels are then mounted on the frame or grid. In some instances, clips are provided to secure and position the panels on the grid structure.

Such systems are in most instances relatively complex and require a number of different structural elements which must be assembled by skilled installers.

SUMMARY OP THE INVENTION

The present invention provides a simple system for installing a panel wall consisting of an array of individual panels in which the panels are accurately positioned in both the vertical and horizontal directions. The system employs positioning rails which are mounted on a support wall to establish the horizontal alignment of each panel in a course of panels. Further, spacer means are provided to accurately position each panel in each course with respect to the next horizontally aligned panel in the course.

With this invention, a plurality of courses are accurately positioned with respect to the next adjacent course until the finished wall, or desired portion thereof, is provided by an array of accurately positioned panels. The system also provides means to accommodate expansion and contraction of the individual panels caused by changes in temperature and humidity conditions.

Several embodiments of this invention are illustrated. In a first embodiment, a ship-lap type joint is provided between adjacent panels. A positioning rail is provided for each course of panels. Each rail provides a projecting rib or key which mates with a groove in the panel of the associated course so that all of the panels in the course are positioned in proper horizontal alignment. Spacer clips are positioned between each panel within the course in the next horizontally positioned panel to provide a uniform spacing between adjacent panels. These clips also cooperate to provide an interlocking joint which maintains adjacent panels parallel and co-planar. These clips are structured to accommodate expansion and contraction between the panels caused by changes in the environmental conditions of temperature and humidity. Further, the joint accommodates expansion and contraction without producing gaps and the like. Further in this embodiment, there are no visible panel mounting means. Still further, a wide variety of finishes and patterns can be provided for special aesthetic effects.

In the second illustrated embodiment, support rails are again provided to establish the vertical position of each course. In this embodiment, an interlocking joint is again provided between individual panels in each course. However, the upper and lower edges of the individual panels are not provided with an interlocking type joint. Instead, the associated rails provide surfaces abutting such upper and lower edges of the panels. Such rails are structured to receive and support battens which provide the trim along the upper and lower edges of the individual panels. Various forms of battens may be installed to provide a variety of edge trim appearances.

This embodiment, however, again uses side clips to establish proper horizontal spacing between the panels in each course. Further, the rails and clips of this second embodiment are also structured to accommodate expansion and contraction of the panels.

In a third illustrated embodiment, support rails are again provided for each course. However, in this embodiment, vertically extending spacer rails are also provided. In this embodiment, battens are installed along all four edges of each panel to provide trim for all panel edges. In this embodiment, the rails are again structured to accommodate panel expansion and contraction in all directions.

Each of the illustrated embodiments provide a structure for easily installing a paneled wall consisting of an array of individual panels in which the panels are accurately positioned. Further with this invention, a variety of trim treatments are available.

These and other aspects of this invention are illustrated in the accompanying drawings and are more fully described in the following specification.

BRIEF DESCRIPTION OF THE DRAWINGS

FIG. 11 is a face view illustrating a portion of a wall panel array in accordance with the embodiment of FIG. 8;

FIG. 12 is a view similar to FIG. 11 but illustrating a variation in the trim which may be provided in an array of panels in accordance with the embodiment of FIG. 8;

FIG. 14 is an enlarged fragmentary section of a batten intersection trim member in accordance with the variation of FIG. 12;

DETAILED DESCRIPTION OF THE DRAWINGS

Figures 1, 1A:
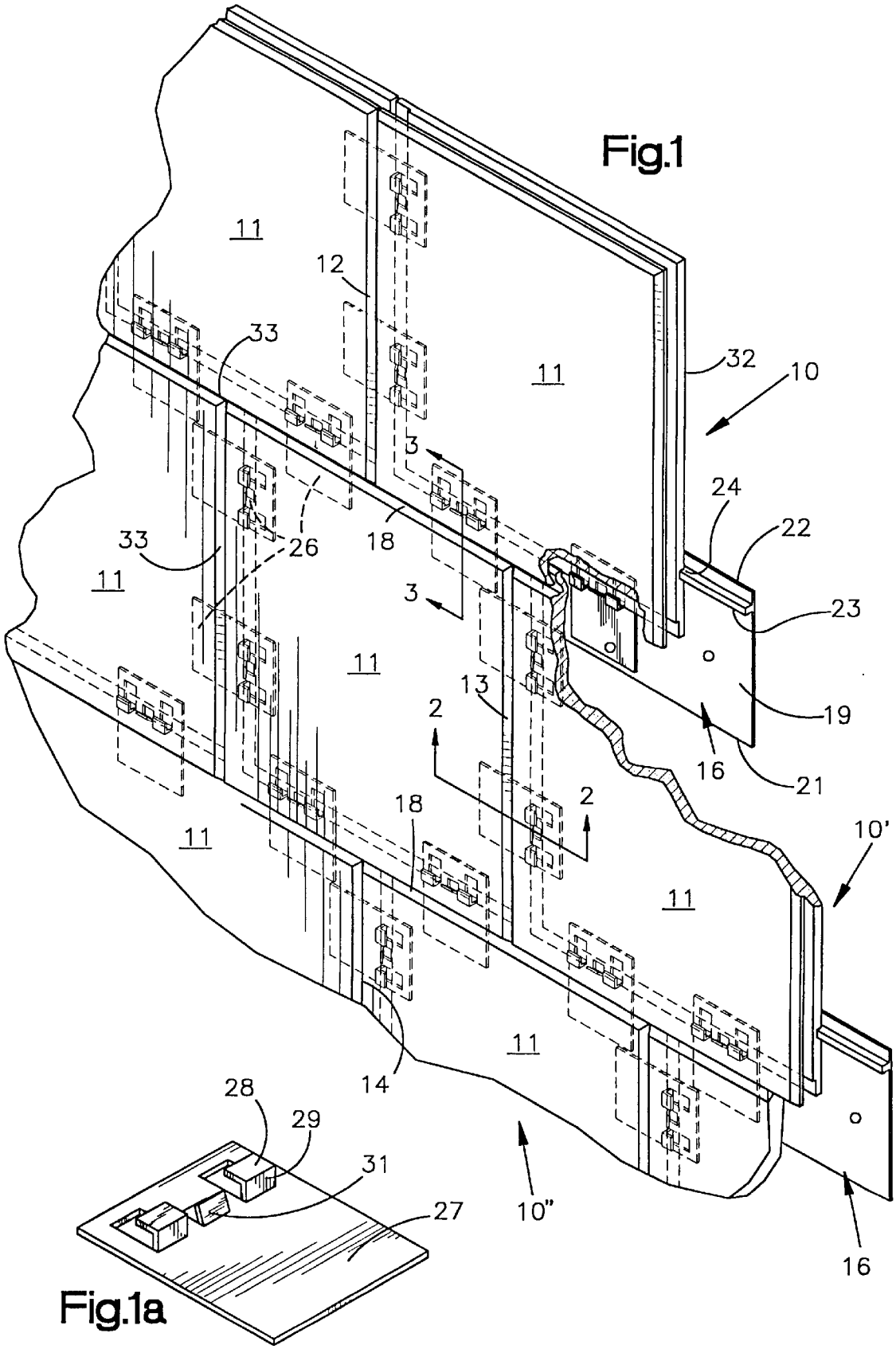
FIG. 1 is a fragmentary prospective view illustrating a portion of a paneled wall system in accordance with the first embodiment of this invention.
FIG. 1*a* is a perspective view of the spacer clips used in the first embodiment to properly interlock and space the individual panels in both the horizontal and vertical directions.
Figure 2:
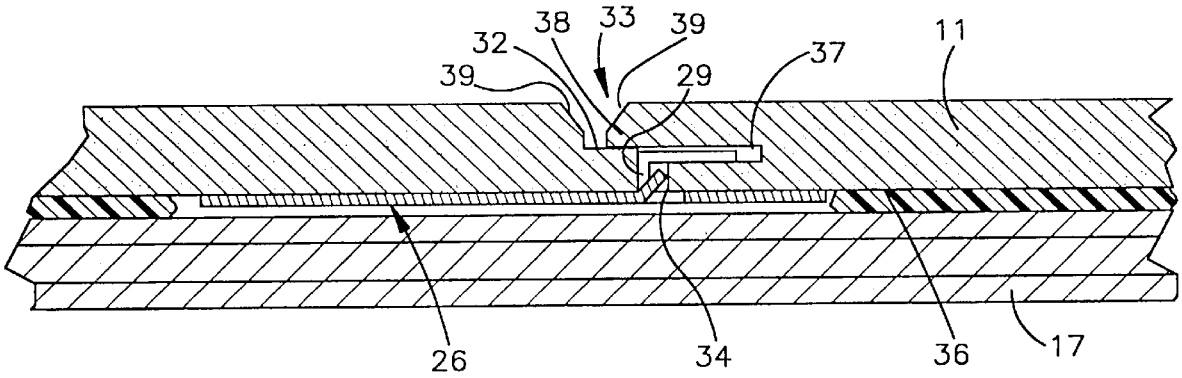
FIG. 2 is of the large fragmentary section taken along 2—2 of FIG. 1 illustrating a vertical joint between adjacent panels within a course.
Figure 3:
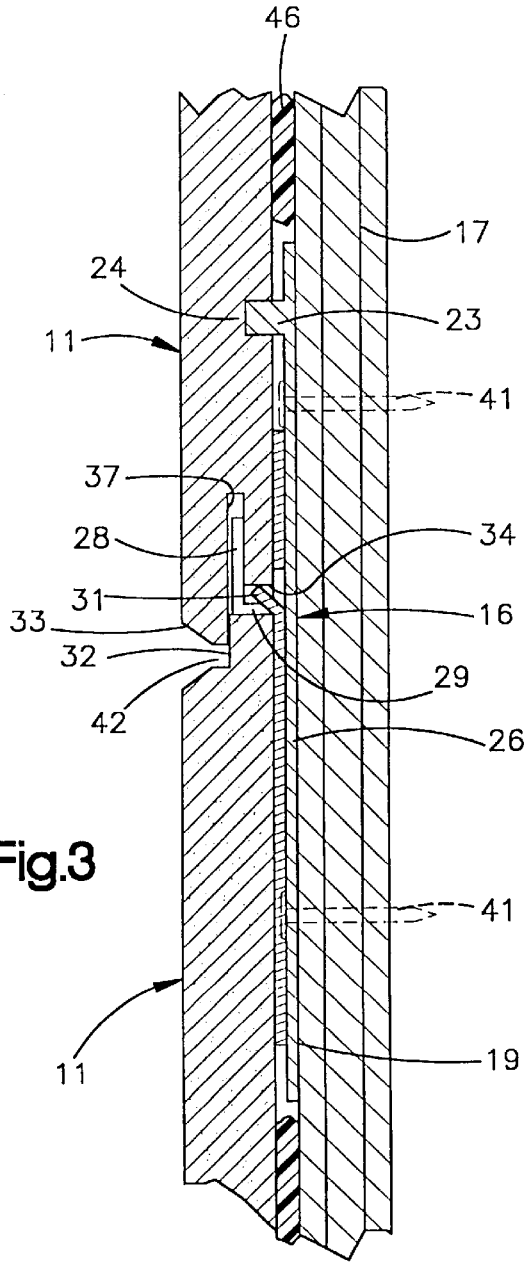
FIG. 3 is an enlarged fragmentary section taken along 3—3 of FIG. 1 illustrating a horizontal joint between adjacent panels.

FIGS. 1 through 3 illustrate a first embodiment of the present invention. In this embodiment and all the other illustrated embodiments, a wall panel system includes a plurality of rectangular or square panels consisting of courses of horizontally aligned panels assembled and mounted to provide a finished wall surface. These individual panels can be provided with substantially any desired surface finish. For example, the panels may be provided with simulated wood grain, abstracts, masonry surfaces and the like. Similarly, the panels may by provided with a wood veneer, a metal finish, high pressure laminates, solid colors, wood fiber surfaces, phosphate cement, fiber reinforced plastic or graphics. This list is only representative of the wide variety of surface finishes that may be provided and is not intended to be all inclusive.

FIG. 1 is a prospective view of a portion of a paneled wall which includes three courses 10, 10' and 10" each including a plurality of horizontally aligned panels 11. It should be understood that the number of courses 10 of the panels 11 varies with the height of the wall being paneled. It should also be understood that in some instances paneling may be applied only along a portion of a wall surface to provide, for example, a special aesthetic effect. Further, the finish provided by individual panels within a given wall need not be identical. Panels of various finishes may be mixed when desired for special aesthetic effects. On the other hand, in many instances all of the panels within a given wall assembly may be provided with substantially identical surface finishes.

In the first embodiment, an interlocking type joint is provided between adjacent panels in each course and between the panels in the vertically adjacent courses. In FIG. 1, an arrangement is illustrated in which the panels in vertically adjacent courses 10 are offset so that the vertical joints 12 of the course 10 are offset from the vertical joints 13 of the course 10' and are in alignment with the vertical joints 14 of the course 10". Also in the panels are square, for example having side dimensions of two feet. However, other panels dimensions and shapes in accordance with the present invention may also be provided.

A simple rail and clip system in utilized to insure that all of the panels within a given wall surface are properly positioned with respect to each other. The clips also provide an interlock and a structure which accommodates a limited amount of panel expansion and contraction resulting from environmental temperature and humidity variations. Rails 16 are mounted on the supporting subwalls 17 (illustrated in FIG. 3). A rail 16 is mounted to extend along each horizontal joint 18 between vertically adjacent courses 10. Each rail 16 includes a vertically extending planar body portion 19 extending from a lower edge 21 below the adjacent horizontal joint 18, and an upper edge 22 located above the associated horizontal joint 18. Therefore, the body portion bridges the horizontal joint 18 between associated adjacent courses 10.

The rail 16 also includes a horizontally extending lateral tongue 23 substantially adjacent to the upper edge 22. This tongue fits into a mating groove 24 formed in the back surface of each panel 11 within the associated course. This tongue automatically insures that each of the panels 11 within a given course is positioned in proper horizontal alignment. A small clearance is provided between the tongue 23 and associated groove to accommodate expansion and contraction.

Spacer clips 26 are also provided along the horizontal and vertical joints between adjacent panels. As best illustrated in FIG. 1*a*, each spacer clip 26 is provided with a planar base portion 27 joined to a pair of planar retainer portions 28 by offset portions 29. The two planar portions 27 and 28 are laterally spaced from each other but are parallel. The offset portions 29 extend perpendicular to the planar portions. A spacing tab 31 is lance cut from portion 27 and extends at an angle relative thereto. This tab establishes a uniform spacing between adjacent panels as discussed below.

In this first embodiment, each of the panels is provided with a tongue 32 extending along its top edge and its right vertical edge of the panels (as viewed in FIG. 1). The bottom and left vertical edge (again as viewed in FIG. 1) are formed with a mating lap portion 33. As best illustrated in FIGS. 2 and 3, the lap portion is formed by cutting away the backside of the panel of each panel to provide a rearward edge wall 34 extending from the back face 36 of each panel 11 to a lateral groove 37. This lateral groove 37 extends back from the adjacent edge wall 34 of the panel beyond the edge wall 34. When installed, the lap portion 33 fits over the associated tongue 32 of the adjacent panel to give a ship-lap type joint between adjacent panels along the various edges thereof. The face edge of the lap portion 33 and adjacent to the tongue 32 of the adjacent panel are provided with a bevel 39 to provide a finished edge appearance along all edges of the panels.

As best illustrated in FIG. 3, the rails 16 positioned along the horizontal joints between courses are fastened by nails 41, or other suitable fasteners, to the subwall 17. The rails 16 are positioned so that the tongues 23 extend into the grooves 24. The clips 26 are then installed and secured with adhesive along the bottom of the panels 11 in the course next above. The spacing tab 31 engages the rearward edge wall 34 of such panel. Since the tongue 32 of the next panel below is positioned against the lateral wall 29, the clip establishes a predetermined spacing between the tongue 32 and such edge wall 34. This establishes a uniform gap 42 between the exposed edges of adjacent panels along the horizontal joints. Further, the retainer portions 28 of the clips 28 extend into the grooves 37 to hold lower edge of the panels against the rail. The lap joint at the top of the panels holds the upper edge of each panel in adjacent to the wall.

In addition, the clips 28 also function to modify the ship-lap type joint to effect a tongue and groove joint in which the adjacent panels are interlocked so that the faces of adjacent panels are held in a co-planar relationship. This simple clip, therefore, functions to interlock the adjacent panels but also functions to produce a uniform spacing between panels. Further, the clip is structured with a tongue 31 which is deflectable to accommodate expansion of the panels.

A similar uniform gap is provided along vertical joints between adjacent panels in each course by the spacer clips 26 positioned along such vertical joints. In this instance, the spacer clips are merely positioned at space locations along the associated vertical joint. If desired, adhesive can be used to hold the clips to the subwall.

Preferably, the rails 16 are extruded from a corrosion resistant material, such as aluminum or a suitable plastic and the spacer clips are stamped from sheet metal such as aluminum or steel.

Figure 3A:
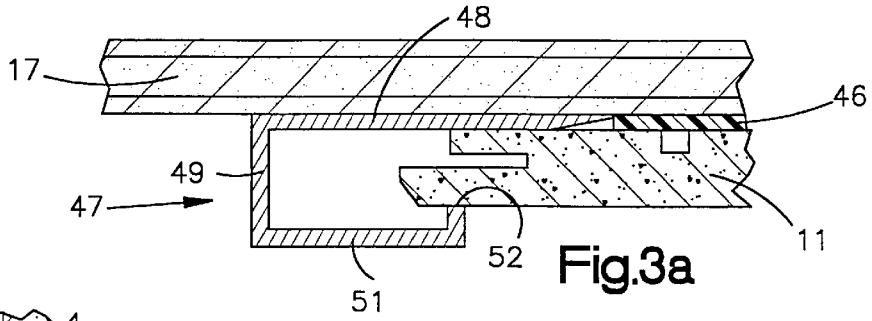
FIG. 3*a* is a fragmentary section taken of an array of the first embodiment illustrating one form of trim which may be used to provide a finished edge trim.

The paneled wall in accordance with the first embodiment of this invention, illustrated in FIGS. 1 through 3, may be installed as follows. An edge molding or trim 47 (as illustrated in FIG. 3*a*) is be nailed in place along the upper edge of the uppermost course of paneling. Such edge molding or trim provides a base portion 48 having the same thickness as the planar mounting or body portion of the rails 16. It also provides a lateral portion 49 joining the base portion to a face portion 51 extending to an edge 52 spaced from the base portion 48 by a distance equal the thickness of the panel 11. When the trim strip 47 is utilized at the junction between the walls and the ceiling, the base portion properly spaces the upper edge of the upper course of panels from the subwall 17. Further, the engagement between the edge 52 and the face of the panel holds the upper edge of the panels in proper position with respect to the subwall 17. The edge trim 47 may also be used along the side edges and bottom edges of a panel system.

It is important to be sure that the uppermost full rail is positioned accurately in a horizontal direction since subsequent rails below are preferably spaced from the uppermost full rail by the use of gauge blocks or the like to ensure exact proper spacing of each rail relative to the rails on either side.

Adhesive 46 is then applied to the surface of the panel 11 and the uppermost course is installed progressively positioning the panels from one end of the uppermost course with each panel groove 24 fitting over the associated rib 23. This ensures that each panel within the uppermost course is positioned in proper horizontal alignment.

As the panels are installed, spacer clips 26 are positioned along the vertical edge to automatically establish the proper horizontal spacing between adjacent panels.

The next adjacent panel is then installed by fitting such panel over the tongue 23 of the associated rail and sliding it horizontally toward the previously installed panel until the spacer clips along the vertical edges establish the proper horizontal spacing gap between each horizontally aligned panel. Such installation is repeated until a full course of panels is installed. During such installation of a course, the spacer clips along the horizontal joints 18 are pressed up into the associated groove 37 and the exposed base portion 27 is glued to the rail. These spacer clips along horizontal joints insure that the lower edges of the panels are held back against the wall in proper position.

In a similar manner, the next course below is progressively installed from one end. In this instance, the upper tongue 32 of the next adjacent lower course is fitted up behind the lower lap portion 38 of the next adjacent course above and this firmly retains the upper edges of each panel against the wall. After completion of the installation of each course, the next course below is progressively installed in a similar manner until the entire panel system is completed.

Figure 3C:
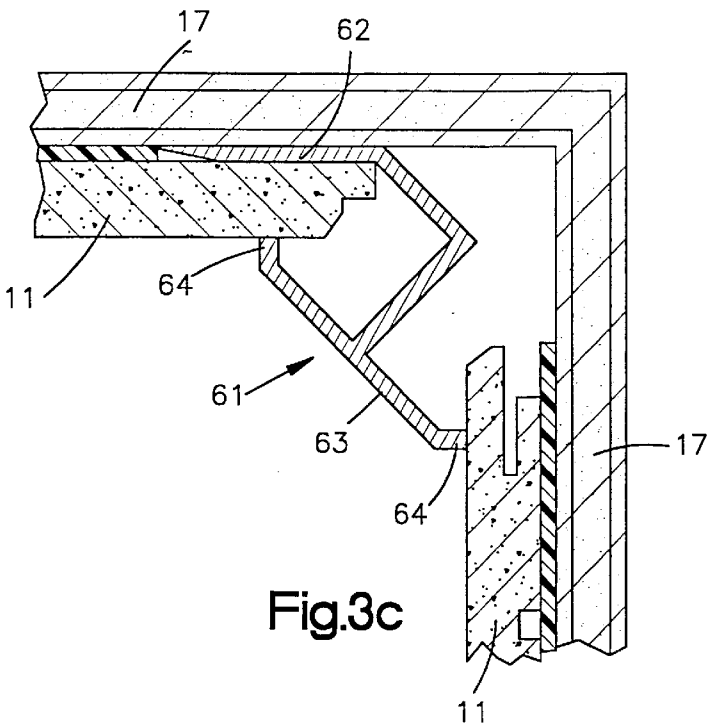
FIG. 3*c* is a fragmentary section taken along an inside corner of an array of panels of the first embodiment illustrating a form of trim that may be used to provide a finished inside corner trim.
Figure 3B:
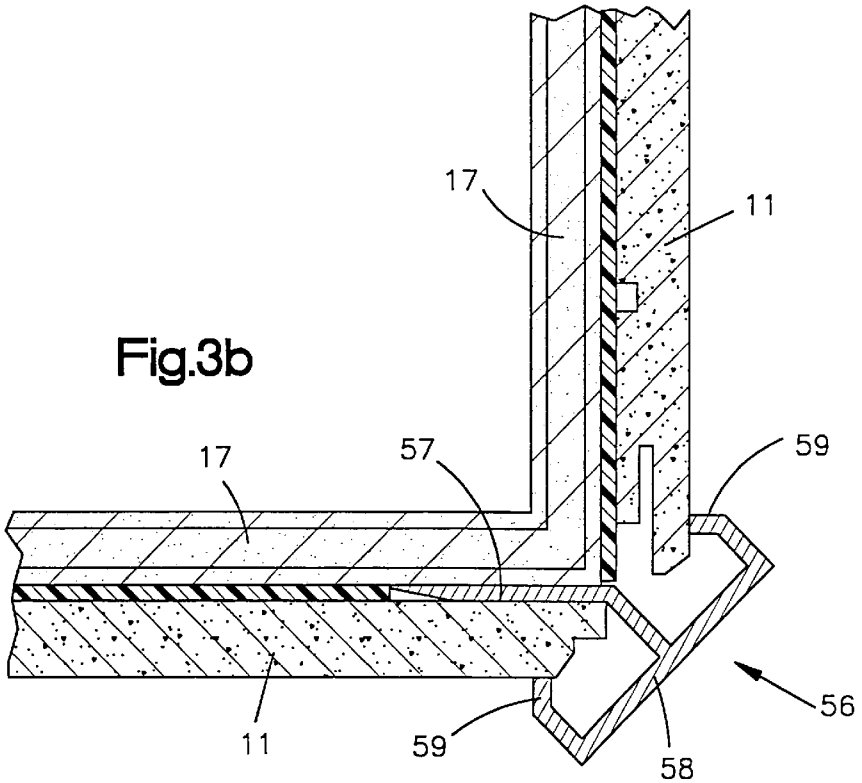
FIG. 3*b* is a fragmentary section taken along an outside corner in an array of panels of the first embodiment illustrating one form of trim that maybe used to provide a finished outside corner trim.

FIG. 3*b* illustrates an outside corner trim 56 for finishing the edges of the panel system at an outside corner. This outside corner trim 56 is again provided with a base portion 57 which is nailed in place. The base portion fits between an adjacent panel 11 and the subwall, 17 adjacent an outside corner in the subwall. A face portion 58 is supported from the base portion 57 and extends at an angle of substantially 450 with respect to the adjacent wall panels. In this trim strip, the face portion terminates at two edges 59 which respectively engage the surface of the adjacent panels 11 and cooperate with the face portion to enclose the edges of the panels 11.

FIG. 3*c* illustrates an inside corner trim strip 61 which may be used to finish the edges of a panel system forming an inside corner. Here again, the trim strip provides a base portion 62 which is nailed to the subwall and fits between adjacent panels 11 and the adjacent portion of the subwall 17. In this instance, the face portion 63 is again inclined at 45° with respect to both adjacent panels 11 and provides edges 64 which respectively engage the faces of adjacent panels. The trim strip 61 is shaped to bridge between adjacent panels at inside corners and to conceal the edges thereof. The trim strips 47, 56 and 61 are sized so that they cover the edges of associated panels 11 a sufficient amount to conceal the ship lap edges. This insures that the panels need not be trimmed when the trim strips are used.

It should be understood that even though the trim strips 47, 56 and 61 each provide substantially planar face portions that similar trim strips can be provided with face portions which are curved or otherwise shaped to provide various aesthetic effects.

FIGS. 4 through 7 illustrate a second embodiment of this invention in which battens may be mounted along horizontal joints between adjacent panels. In this embodiment, similar reference numerals are used to designate parts which correspond to similar parts in the first embodiment. However, (a) will be added to indicate that reference is being made to the second embodiment of FIGS. 4 through 7.

Figure 4:
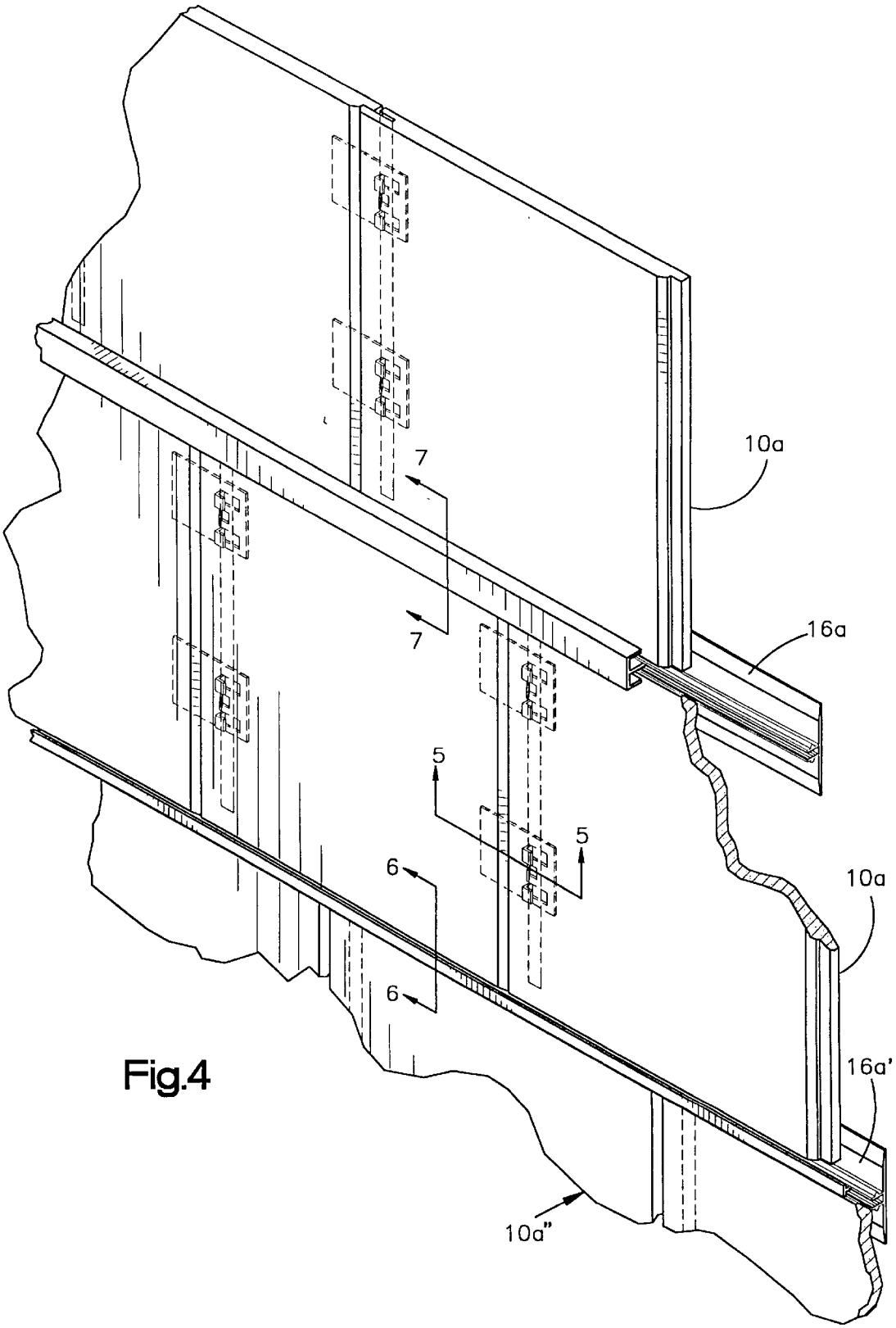
FIG. 4 is a fragmentary prospective view illustrating a second embodiment of this invention in which horizontally extending support rails are structured for the mounting of horizontally extending battens to provide edge trim between adjacent courses.
Figure 5:
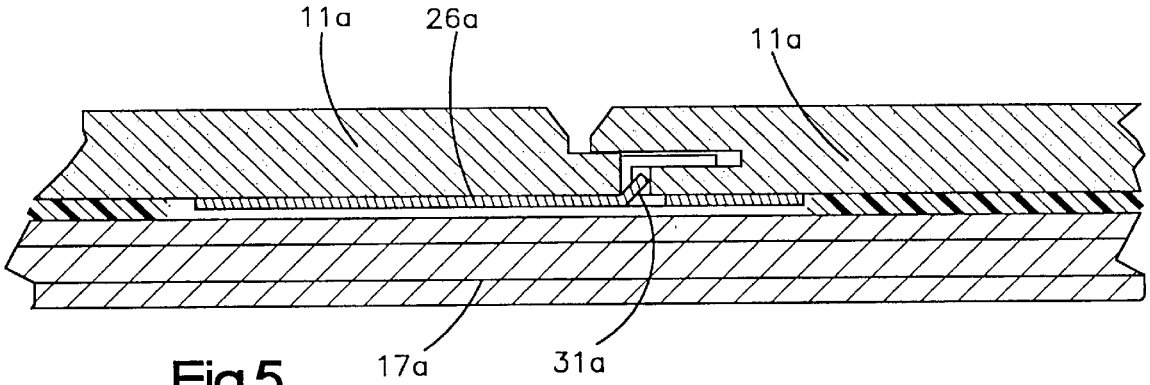
FIG. 5 is an enlarged fragmentary section illustrating a vertical joint between adjacent panels within the course of horizontally aligned panels.

Here again, the panels are positioned in courses consisting of a plurality of horizontally aligned panels. In FIG. 4, portions of three courses 10*a* are illustrated. However, it should be understood that in a typical array forming a paneled wall additional courses 10*a* may be provided depending upon the height of the wall and the dimensions of the panels themselves.

In this embodiment, horizontally extending rails 16*a* are again secured to a subwall 17*a* (illustrated in FIGS. 5 through 7) by suitable fasteners such as nails or screws. Each rail is provided with a planar mounting or body portion 19*a* and a pair of laterally extending opposed walls 66*a* and 67*a*. These walls cooperate to form a U-shaped channel 68*a* and are provided with interior rearwardly inclined tooth like projections 69*a*. The outer side of each of the opposed walls 66*a* and 67*a* are formed with a spacer projection 71*a* which operate to space the adjacent edges of the adjacent panels 11*a* a small distance from the associated opposed walls.

Figure 6:
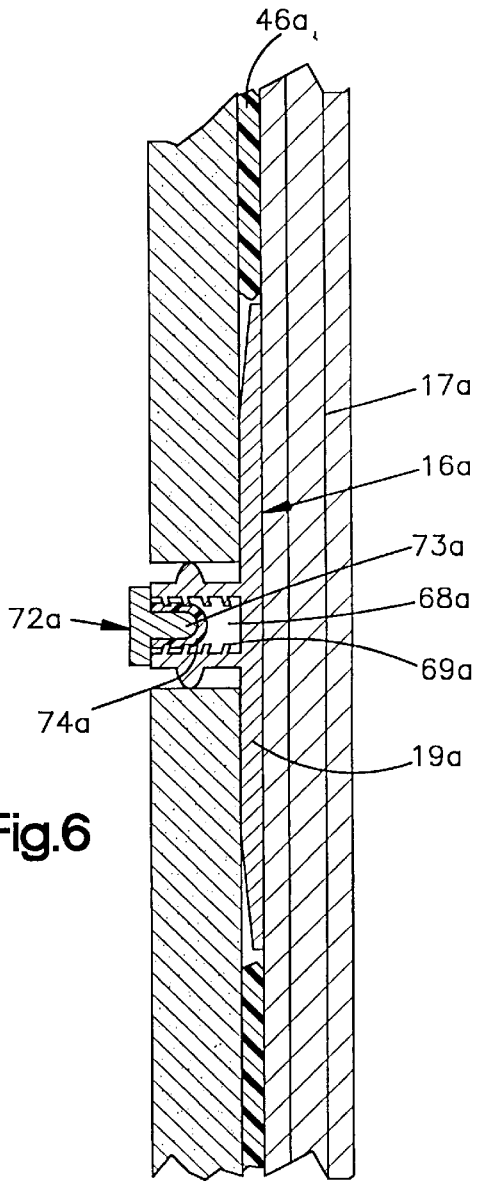
FIG. 6 is an enlarged fragmentary section taken along 6—6 of FIG. 4 illustrating a horizontal joint between adjacent courses with a first type of trim batten mounted at such joint.

In this embodiment, only the vertically extending edges of the panels 11*a* are formed with a ship-lap type edge configuration similar to the edge configurations of the first embodiment. However, the top and bottom edges of the panels are formed with a square cut edge. In this embodiment, the vertical position of the panels in each course is determined by the spacer rib or projection 71*a* engaging the lower edge of the panel. The horizontal spacing and interlocking between horizontally aligned panels 11*a* within each course is again determined by the spacer clips 26*a* in the same manner as in the first embodiment. Here again, the horizontal rails 16*a* are installed in vertically spaced parallel relationship on the subwall 17*a*. Adhesive 46*a* is then applied and the panels within each course are assembled progressively from one end. In this embodiment, however, battens are installed to trim the horizontal joints between adjacent courses. FIG. 6 illustrates a small batten 72*a* having a tongue 73*a* which projects into the U-shaped channel 68*a* to mount the batten in place. Preferably, adhesive film 74*a* is applied to the tongue 73*a* before its insertion into the channel 68*a* to assist the tooth like projections 79*a* and retaining the batten in its installed position.

Figure 7:
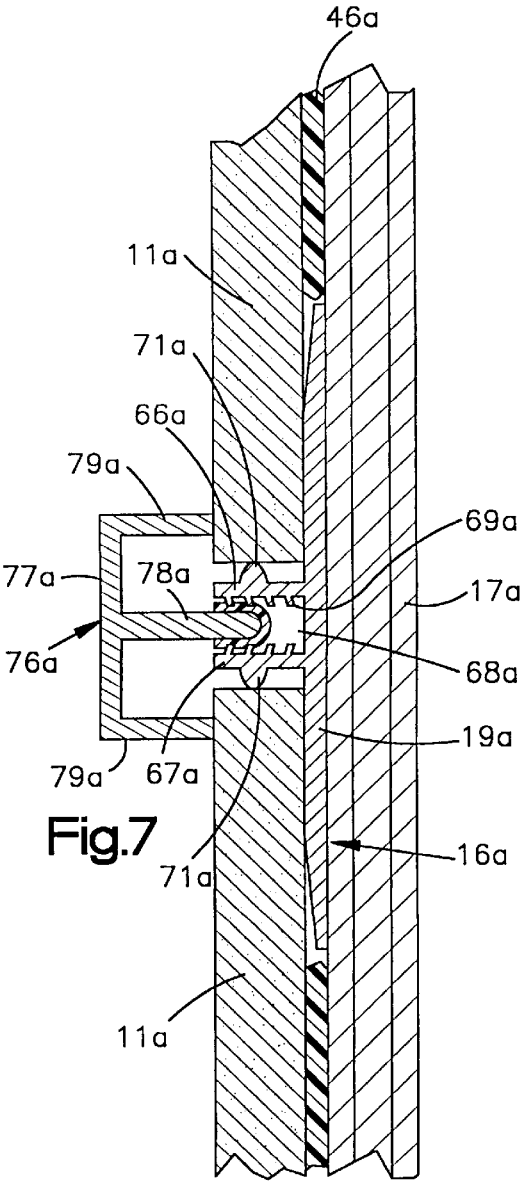
FIG. 7 is an enlarged fragmentary section taken along 7—7 of FIG. 4 illustrating a horizontal joint between adjacent courses with another form of trim batten installed in the associated runner.
Figure 8:
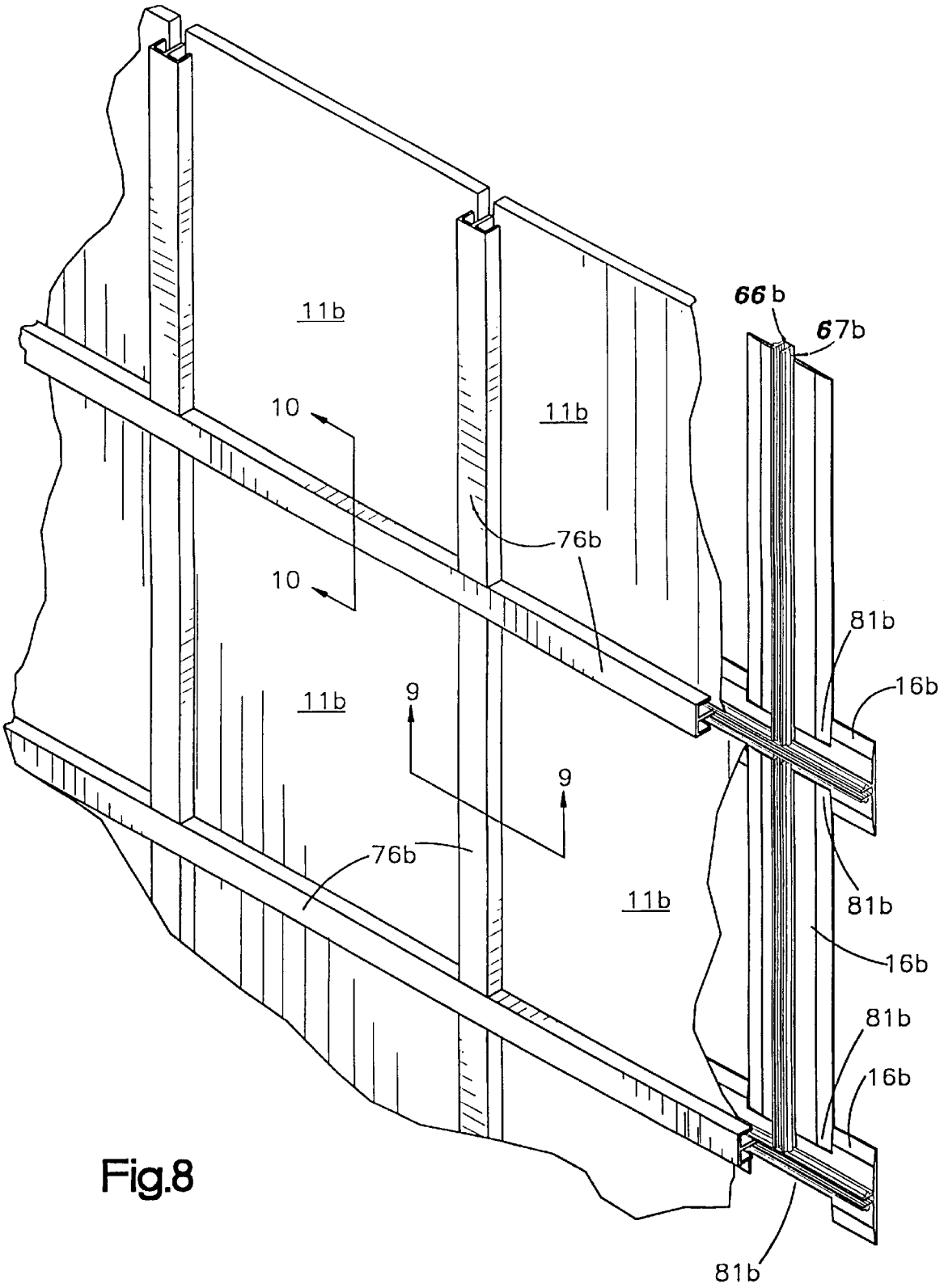
FIG. 8 is fragmentary prospective view of a third embodiment of this invention in which horizontal and vertical spacer runners are provided and in which trim battens are installed along all edges of the panels.
Figure 9:
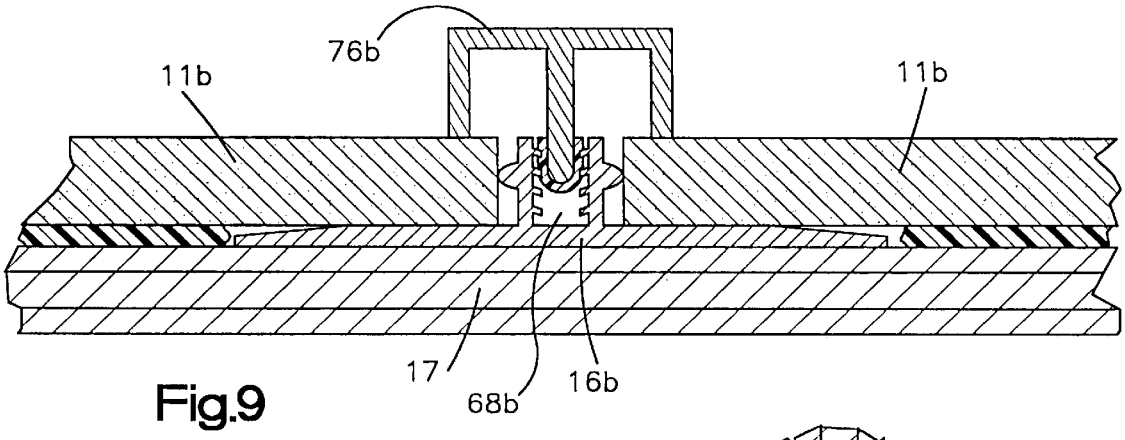
FIG. 9 is an enlarged fragmentary section taken along 9—9 of FIG. 8 illustrating a vertical joint between adjacent panels with a batten installed therealong.
Figure 10:
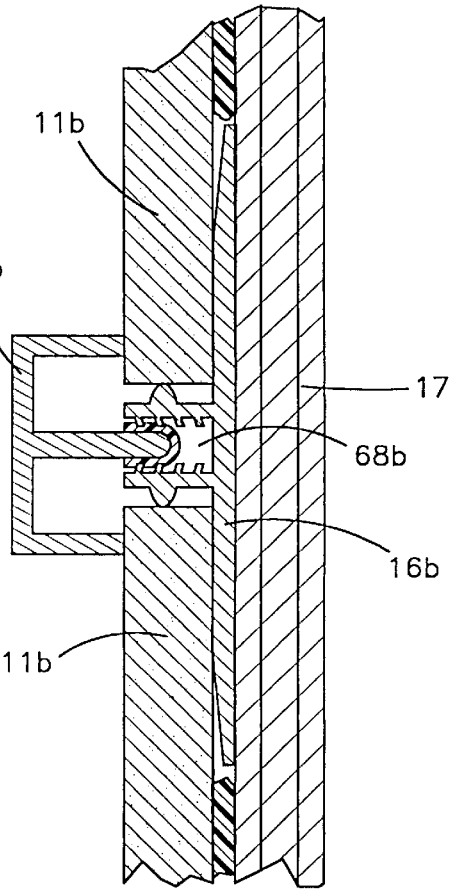
FIG. 10 is an enlarged fragmentary section taken along 10—10 of FIG. 8 illustrating a horizontal joint with a batten installed therealong.
Figure 13:
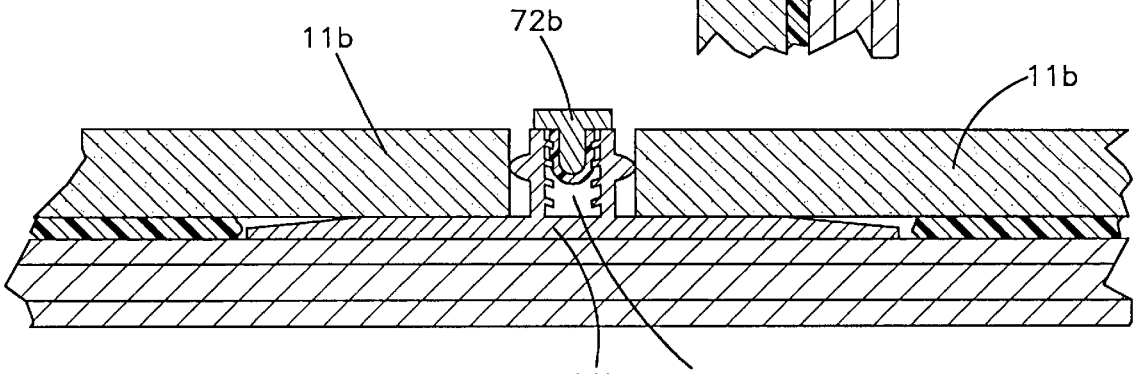
FIG. 13 is an enlarged fragmentary section illustrating the structure of both the vertical and horizontal joints provided in the variation of FIG. 12.

FIG. 7 illustrates the installation of a larger batten 76*a* which is provided with a face portion 77*a* sufficiently wide to bridge across the entire horizontal joint. The batten is again provided with a tongue 78*a* which projects into the channel 68*a* and is locked therein by adhesive film and the tooth like projection 69*a*. At the extremities of the face portion 77*a*, the batten 76*a* is provided with inwardly extending legs 79*a* which extend inwardly into engagement with the outer surface of the adjacent panels 11*a*. This batten configuration completely conceals the edges of the panels along a horizontal joint and provides a very finished appearance. It should be understood that although the batten 76*a* is substantially rectangular in shape, battens with other external appearances may also be applied. For example, battens formed with a curved configuration may be used when a softer look is desired.

Here again, provision is made to accommodate expansion and contraction created by changes in the environmental temperature and humidity. Horizontal expansion is accommodated by deflection of the spacing tab 31*a* of the spacer clips and vertical expansion merely causes the spacer ribs 71*a* to penetrate into the edge of the panel a small distance. For this reason, the spacer rib 71*a* is formed with a relatively sharp edge to facilitate such penetration. Here again, the rails are preferably formed as extrusions from a corrosive resistant material such as aluminum or plastic. Similarly, the battens are also extruded. The battens may be provided with a variety of color and/or finishes to provide a variety of aesthetic effects.

The third embodiment of this invention is illustrated in FIGS. 8 through 13. In this embodiment, similar reference numerals are used to indicate parts which correspond with parts illustrated and discussed in the prior embodiments. However, a (b) is added to indicate reference to the third embodiment.

Here again, horizontal rails 16*b* are mounted with nails or other suitable fasteners on the subwall 17*b*. The vertical spacing between adjacent horizontal rails is selected to accommodate the vertical height of the panels 11*b*. Preferably, gaging blocks or the like are employed to establish the proper vertical spacing between adjacent rails and to eliminate the need for close measurements.

This embodiment also provides vertically extending rails 16*b* which extend along the vertical joints between adjacent panels 11*b*. The vertical and horizontal rails 16*b* of this embodiment have same configuration described above in connection with the rails 17*a* of the second embodiment. In this instance, however, it is preferable to provide indexing notches 81*b* at proper intervals along the edges of the horizontal rails sized to receive the ends of the vertical rails. Such notches ensure the proper horizontal spacing between the vertical rails. In this embodiment the horizontal rails extend continuously along the length of the paneled wall and the vertical rails are cut in length so as to fit into the notches 81*b* between adjacent horizontal rails. The opposed walls 66*b* and 67*b* extend beyond the end of the base of the vertical rails 16*b* and overlap the base of the horizontal rails 16*b*. This ensures that co-planar relationship exists. Once the horizontal and vertical rails are installed, the panels 11*b* are merely pressed into place against adhesive 46*b* to permanently adhere the panels in place. After the panels are installed, suitable battens 72*b* or 76*b* are installed within the channels 68*b*. Vertical battens are then installed in the channels 68*b* of the vertically extending rails.

FIG. 11 illustrates the appearance produced in a paneled wall when the larger sized battens 76*b* are installed in both the vertical and horizontal direction. In this instance, a relatively broad boarder appearance is provided around each panel.

FIG. 12 illustrates the appearance of a paneled wall obtained when the narrow battens 72*b* are installed in the vertical and horizontal directions. At intersection an intersection block 86*b* (illustrated in FIG. 14) is installed at the corners of the panels. This block 86*b* is provided with a square face 87*b* and a tongue 88*b* which extends into the channel of the horizontal rail extending through the intersection. With this embodiment in which battens are applied along the vertical and horizontal joints between adjacent panels, a large variety of aesthetic effects can be achieved, particularly since such battens may be formed with a variety of external shapes and finishes.

Figure 15A:
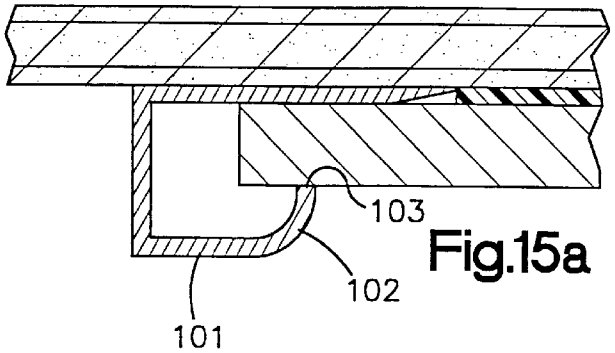
FIG. 15*a* is a fragmentary section at the edge of an array of panels illustrating another form of edge trim having a rounded appearance.

FIGS. 15*a* through 15*d* illustrate a variation in the form of battens and edge trims which may be used to provide a softer appearance. As illustrated in FIG. 15*a*, the edge trim is formed with a forward face 101 which extends with a curve 102 to the face edge 103. This edge trim may be used in the same manner as the edge trim illustrated in FIG. 3*a*, but provides a softer appearance.

Figure 15B:
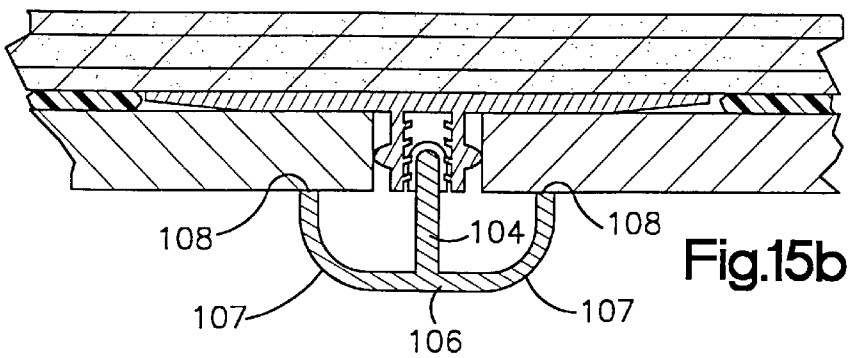
FIG. 15*b* is a fragmentary section of another form of batten which may be used to provide a rounded appearance.

FIG. 15*b* illustrates a batten again provided with a tongue 104 which projects into and mounts the batten within a rail described above for receiving battens. In this instance, the face portion 106 is rounded at 107 as it extends to the face edges 108. Here again, a rounded, softer appearance is provided.

Figure 15C:
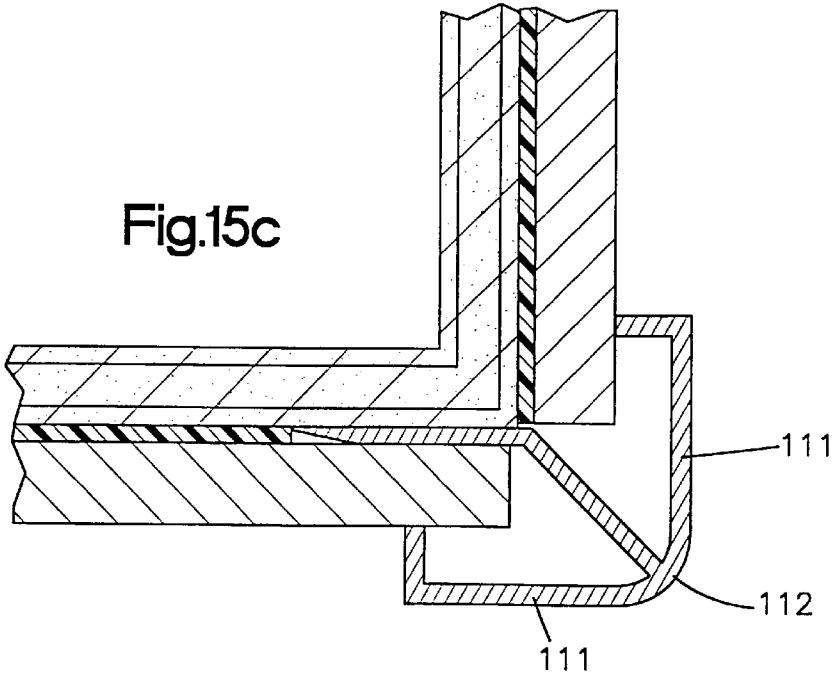
FIG. 15*c* is a fragmentary section illustrating another form of outside corner trim with a rounded appearance.

FIG. 15*c* illustrates a trim strip for an outside corner which is mounted in a manner similar to the previously described corner trim strips. In this instance, however, the face portion 111 is provided portions extending parallel to the adjacent panel faces and with a rounded corner 112.

Figure 15D:
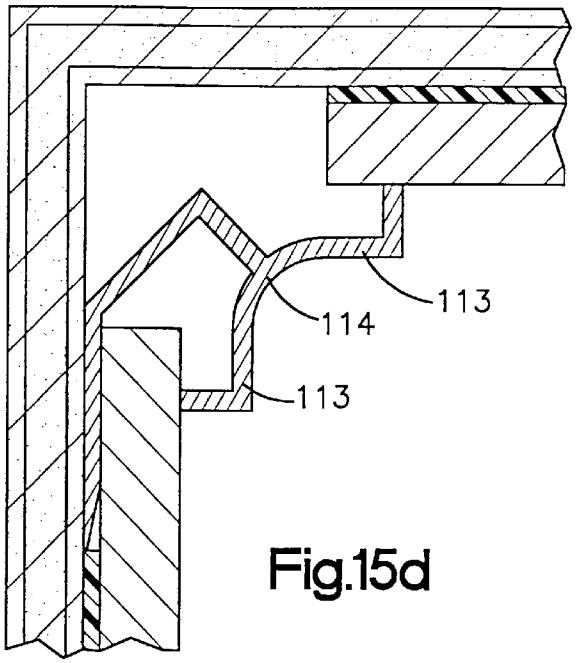
FIG. 15*d* is a fragmentary section illustrating an inside corner trim having a rounded appearance.

FIG. 15*d* illustrates a trim strip for inside corners which is mounted in a manner similar to the manner described above. In this variation of trim strip, however, the face portion 113 provides face portions extending parallel to the face of adjacent panels and is rounded at the inner corner 114 to again provide a softer appearance.

Figure 16B:
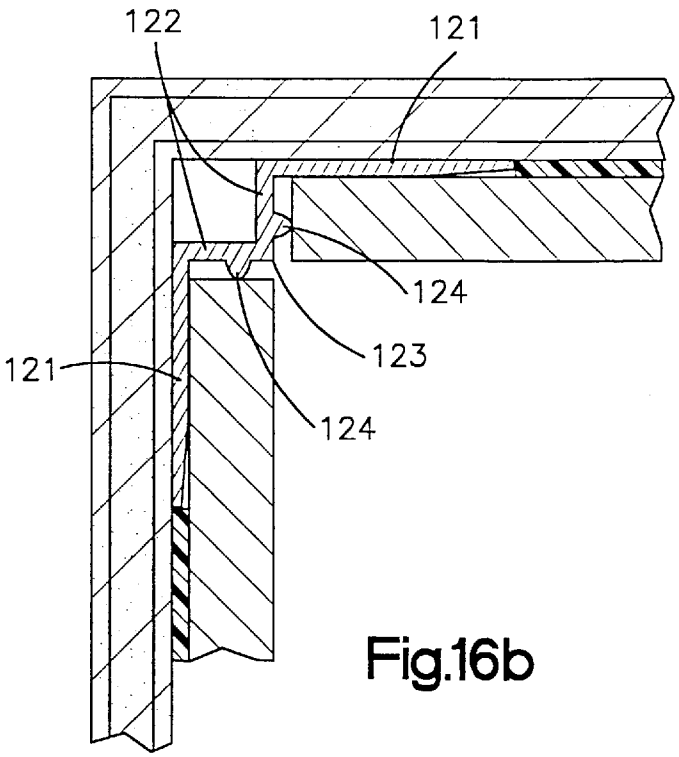
FIG. 16*b* is a fragmentary section illustrating another form of inside corner trim.
Figure 16A:
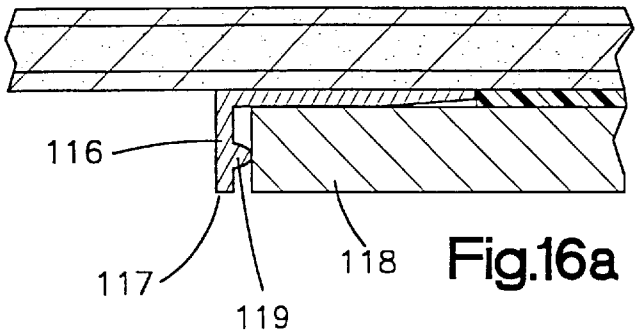
FIG. 16*a* is a fragmentary section illustrating another form of edge trim.
Figure 16C:
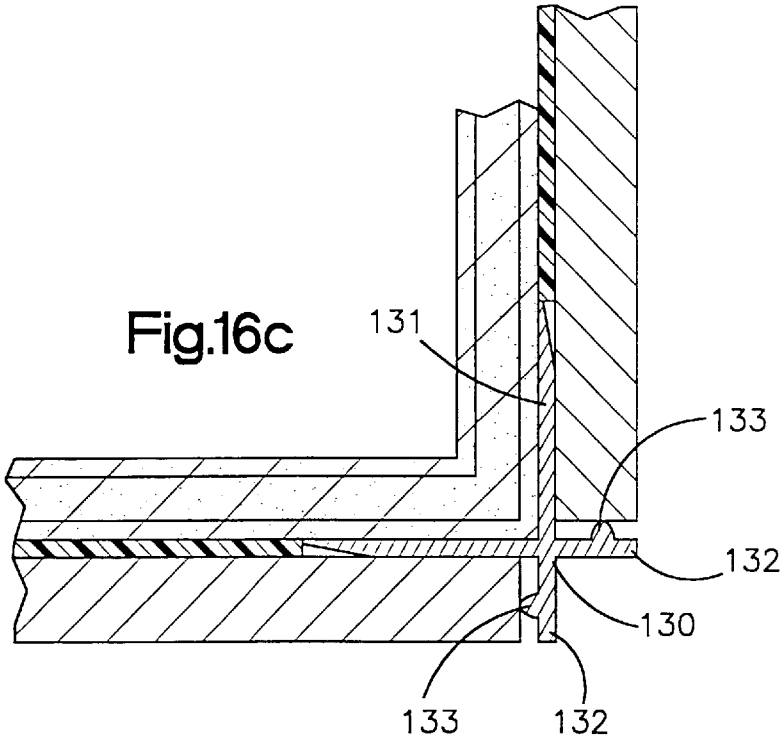
FIG. 16*c* is a fragmentary section illustrating another form of outside corner trim.

FIGS. 16*a* through 16*c* illustrate another form of trim which may be utilized for a different aesthetic effect. The edge trim illustrated in FIG. 16*a* includes a lateral wall 116 which extends to an edge 117 aligned with the face 118 of adjacent panels. In this instance, the lateral wall 116 is provided with a spacing ribs 119 for proper spacing and to allow expansion and contraction of the panels as described above.

FIG. 16*b* illustrates an inside corner trim strip having an external appearance similar to the edge trim of FIG. 16*a*. The trim strip provides perpendicularly extending mounting portions 121 for mounting the trim strip on the base wall. In this instance, a corner structure provides perpendicularly extending lateral walls 122 which join at a corner 123 aligned with the face of the adjacent panel. Each of the lateral walls 122 is provided with a spacer rib or tongue 124 for positioning the adjacent panels. These tongues are sized and shaped to allow a limited amount of expansion of the adjacent panels in the manner discussed above.

FIG. 16*c* illustrates an outside corner trim member 130 similar to the trim members of FIGS. 16*a* and 16*b*. This trim member is again provided with mounting portions 131 which extend along the adjacent subwall. In this instance, a pair of perpendicularly extending wall projections 132 extend to a location in alignment with the face of the adjacent panels. Also these projections 132 are provided with spacer ribs.

In accordance with each of the embodiments of this invention, accurate panel positioning is achieved with a minimum of measurements so that a large variety of aesthetic effects can be obtained without requiring a high content of skilled labor during the installation process. Further, because a large variety of panel finishes can be employed and various trim strips can be applied, the variations in aesthetic effects are virtually limitless.

Although the preferred embodiments of this invention have been shown and described, it should be understood that various modifications and rearrangements of the parts maybe resorted to without departing from the scope of the invention as disclosed and claimed herein.

I claim:

1. A wall panel system comprising a vertically extending support wall, first rails and second rails, one of said first and second rails comprising a plurality of horizontally extending vertically spaced positioning rails mounted on said support wall, said horizontally extending positioning rails providing horizontally extending alignment means, a plurality of individual panels engaging said alignment means of associated horizontally extending positioning rails and being positioned thereby in horizontally aligned courses of panels, adhesive bonding said panels to said support wall, the vertical spacing between said horizontally extending positioning rails operating to vertically position each course with respect to the next adjacent course to form a uniform pattern of panels providing a finished panel wall surface, the other of said first and second rails comprising a plurality of vertically extending positioning rails located along vertical joints between adjacent panels in said courses, said vertically extending positioning rails having vertically extending alignment means engaging adjacent edges of panels along said vertical joints, said positioning rails having base portions extending between spaced base portion ends and said alignment means projecting from said base portions, said base portions being disposed against said support wall with said alignment means engaging associated ones of said panels, at least one of said positioning rails having said alignment means extending beyond said base portion end of said base portion of said at least one of said positioning rails for overlying engagement with the base portion of the other of said positioning rails.

2. A wall panel system as set forth in claim 1, wherein said alignment means of said at least one of said positioning rails includes at least one wall projecting from and extending along said base portion.

3. A wall panel system as set forth in claim 2, wherein said at least one of said positioning rails comprises said vertically extending positioning rails.

4. A wall panel system as set forth in claim 1, wherein said alignment means of said at least one of said positioning rails includes a pair of spaced walls projecting from and extending along said base portion.

5. A wall panel system as set forth in claim 1, wherein said alignment means of said at least one of said positioning rails comprises said vertically extending alignment means, and said vertically extending alignment means comprise a pair of horizontally spaced walls.

6. A wall panel system as set forth in claim 5, wherein said horizontally extending alignment means comprise at least one wall projecting from and extending along said base portion of said horizontally extending positioning rails.

7. A wall panel system as set forth in claim 5, wherein said horizontally extending alignment means comprise a pair of vertically spaced parallel walls projecting from and extending along said base portion of said horizontally extending positioning rails.

8. A wall panel system as set forth in claim 1, wherein battens are mounted along said horizontally extending positioning rails.

9. A wall panel system as set forth in claim 1, wherein said alignment means comprise a pair of spaced walls extending along said base portion of said positioning rails and battens are mounted along said alignment means, and said battens provide a tongue extending between said spaced walls of said positioning rails.

10. A wall panel system as set forth in claim 9, wherein said battens have an exposed surface having a width substantially equal to that of said spaced walls.

11. A wall panel system comprising a vertically extending support wall, a plurality of horizontal extending vertically spaced support rails mounted on said support wall, said support rails having base portions disposed against said support wall with wall means projecting therefrom, courses of individual panels mounted between adjacent support rails, said panels having lower edges engaging said wall means to establish the horizontal alignment of each panel in an associated course, said panels being arranged in a uniform pattern providing a finished panel wall surface, and said wall means including a pair of vertically spaced rigid stub walls projecting from said rail base portion between adjacent panel edges without extending beyond said finished panel wall surface, each of said rigid stub walls having an outwardly projecting rib of tapered shape presenting a sharp edge engaging a lowermost extremity of the panel edge at a location spaced from the rigid stub wall, said rib vertically positioning the panels of the course above said rib, said rib supportingly engaging the lowermost extremities of said panel edges and projecting from said base portion a height substantially equal to the spacing between said stub wall and adjacent panel edges.

12. A wall panel system as set forth in claim 11, wherein vertically extending support rails are positioned along vertically extending joints between adjacent panels of said courses, and said vertically extending support rails include base portions having vertically extending alignment means projecting therefrom.

13. A wall panel system as set forth in claim 12, wherein said vertically extending alignment means extend beyond an end of said base portions of said vertically extending support rails for overlying engagement with the base portions of the horizontally extending support rails.

14. A wall panel system as set forth in claim 13, wherein said vertically extending alignment means comprise a wall.

15. A wall panel system comprising a vertically extending support wall, horizontally and vertically extending positioning rails mounted on said wall respectively providing horizontally extending alignment means and vertically extending alignment means, a plurality of individual panels engaging said horizontally extending alignment means of associated horizontally extending positioning rails and being positioned thereby in horizontally aligned courses of panels, adhesive bonding said panels to said support wall, the vertical spacing between said horizontally extending positioning rails operating to vertically position each course with respect to the next adjacent course to form a uniform pattern of panels providing a finished panel wall surface, said vertically extending positioning rails being located along vertical joints between adjacent panels in said courses, said vertically extending alignment means engaging adjacent edges of panels along said vertical joints, said positioning rails having base portions extending between spaced base portion ends and said alignment means projecting from said base portions, said base portions being disposed against said support wall with said alignment means engaging associated ones of said panels, at least one of said positioning rails having said alignment means extending beyond said base portion end of said base portion of said at least one of said positioning rails for overlying engagement with the base portion of the other of said positioning rails.

16. A wall panel system as set forth in claim 15, wherein said alignment means of said at least one of said positioning rails includes at least one wall projecting from and extending along said base portion.

17. A wall panel system as set forth in claim 15, wherein said alignment means of said at least one of said positioning rails comprises said vertically extending alignment means, and said vertically extending alignment means comprise a pair of horizontally spaced walls.

* * * * *